US005907466A

United States Patent [19]

Dressler et al.

[11] Patent Number: 5,907,466

[45] Date of Patent: May 25, 1999

[54] DEVICE AND PROCESS FOR ACTIVATING AT LEAST TWO ELECTROMAGNETIC LOADS

[75] Inventors: Klaus Dressler, Loechgau; Torsten Henke, Waiblingen, both of Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/688,446

[22] Filed: Jul. 30, 1996

[30] Foreign Application Priority Data

Sep. 23, 1995 [DE] Germany ..... 195 35 420
Apr. 30, 1996 [DE] Germany ..... 196 17 264

[51] Int. Cl.[6] ..... H01H 47/00

[52] U.S. Cl. ..... 361/156

[58] Field of Search ..... 361/154–156, 361/191; 307/38–41, 10.1

[56] References Cited

U.S. PATENT DOCUMENTS 3,896,346 7/1975 Ule ..... 361/154

FOREIGN PATENT DOCUMENTS

| | | | |
|---|---|---|---|
| 0 305 342 | 3/1989 | European Pat. Off. | F02D 41/20 |
| 0 305 344 | 3/1989 | European Pat. Off. | F02D 41/20 |
| 37 02 680 | 10/1987 | Germany | H01F 7/18 |
| 44 13 240 | 10/1995 | Germany | H01F 7/18 |
| 1157757 | 7/1969 | United Kingdom | F16D 59/00 |
| 2124044 | 2/1984 | United Kingdom | H01F 7/18 |
| 96/27192 | 9/1996 | WIPO | G11C 11/22 |

*Primary Examiner*—Ronald W. Leja
*Attorney, Agent, or Firm*—Kenyon & Kenyon

[57] ABSTRACT

A device and a process for activating at least two electromagnetic loads, in particular solenoid valves for controlling the amount of fuel to be injected. The load is connected to a voltage source through a bridge circuit. Furthermore, devices for stepping up the voltage are connected in parallel with the voltage source.

10 Claims, 3 Drawing Sheets

DEVICE AND PROCESS FOR ACTIVATING AT LEAST TWO ELECTROMAGNETIC LOADS

BACKGROUND INFORMATION

Unexamined German Patent Application No. DE-OS 19 507 222 describes a device for activating at least one electromagnetic load. With this device, energy released in shutdown is stored in a capacitor and used again in the next starting operation.

In addition, German Patent Application No. 44 13 240 describes a device for activating an electromagnetic load by means of a half-bridge where an energy storage element is provided between the half-bridge and a voltage source.

A disadvantage of this device is that it does not allow recharging.

SUMMARY OF THE INVENTION

With a device for activating an electromagnetic load, an object of the present invention is to provide a device with the simplest possible design where the starting operation is accelerated and the total power consumption is minimized.

The circuit configuration according to the present invention has the advantage that it yields loss-free turn-off. In addition, by reusing the power stored during the turn-off process when starting up, the rate of current rise can be increased. This in turn means that the solenoid valve response time is reduced. These advantages are achieved with a simple construction. Furthermore, due to the rechargeability feature, the charging capacitor can be charged to any desired voltage level.

DETAILED DESCRIPTION

The device according to the present invention is preferably used in internal combustion engines, in particular in self-ignition internal combustion engines, where the dosage of fuel is controlled by electromagnetic valves. These electromagnetic valves are referred to below as loads. However, the present invention is not limited to this application, but can be used wherever fast-acting electromagnetic valves are used.

In such applications, the opening and closing times of a solenoid valve determine the start and stop of injection. The period between the activating of a solenoid valve and the actual opening or closing of the solenoid valve is called the response time. In particular with diesel engines, it is desirable for this response time to be as short as possible.

To achieve the shortest possible response times, the fastest possible rise and fall of power in the load are necessary. Such a rapid rise and fall of power can be achieved by a similarly rapid current rise and fall.

In particular, with so-called pre-injection, where a small amount of fuel is injected prior to the actual main injection, a very high voltage is required to achieve a short response time.

Figure 1:
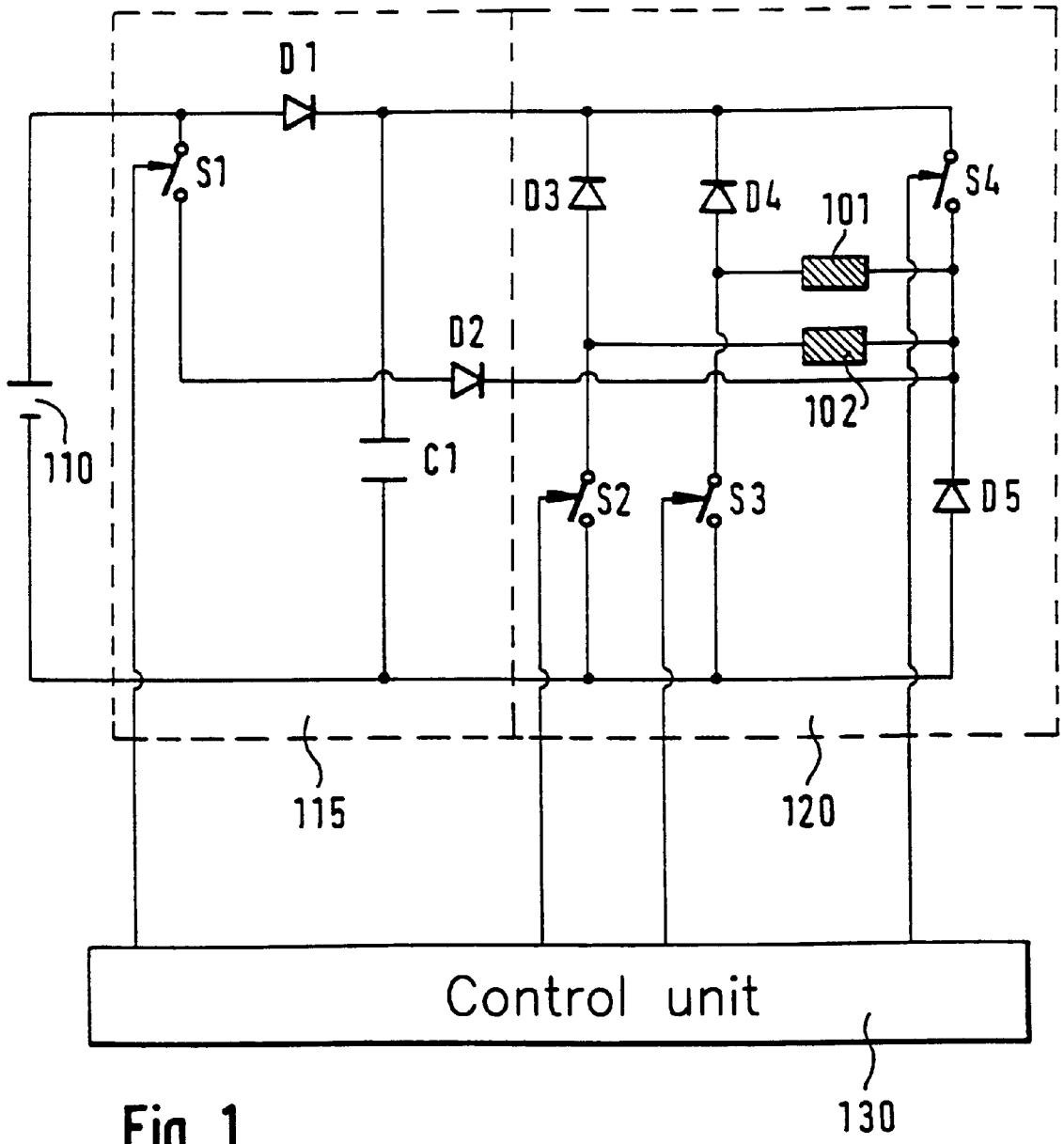
FIG. 1 shows a circuit of the device according to the present invention.

The device according to the present invention illustrated in FIG. 1 is based on the known half-bridge concept. In addition, a storage capacitor is connected in parallel to the voltage source across a series diode.

The most important elements of the device according to the present invention are illustrated in FIG. 1, where 101 and 102 denote two loads to be triggered. However, the process according to the present invention is not limited to two loads. The device shown here can be used with any number of loads.

In addition, a voltage source 110 is connected to a half-bridge 120 via a step-up network 115.

Voltage step-up network 115 includes essentially a first diode D1, a second diode D2, a switch S1 and a capacitor C1. The anode of diode D1 is connected to the positive pole of power supply 110 and the first terminal of switch S1. The cathode of diode D1 is connected to a first terminal of capacitor C1. The second terminal of the capacitor is connected to the negative pole of voltage source 110. Capacitor C1 is connected in parallel to voltage source 110.

The negative pole or the second terminal of capacitor C1 is in contact with a first terminal of load 102 via a second switch S2 and with a first terminal of load 101 via a third switch S3. The second terminal of loads 101 and 102 is in contact with the cathode of diode D1 via a switch S4.

In addition, the tie point between the second terminal of the loads and switch S4 is connected to a cathode of a diode D5 whose anode is in contact with the negative pole of the voltage source. Furthermore, the tie point between the second switch S2 and the first terminal of load 102 is connected to the anode terminal of diode D3. The connecting line between switch S3 and load 101 is in contact with the anode of diode D4.

The cathode terminals of diode D3 and diode D4 are in contact with the cathode terminal of diode D1 and the second terminal of switch S4.

Switches S1 to S4 are preferably integrated switches, in particular transistors or field-effect transistors. They receive activating signals from a control unit 130.

Switches S2 and S3 are usually called low-side switches, while switch S4 is a high-side switch and switch S1 is a recharging switch.

The arrangement of diodes D3, D4 and D5 as well as switches S2, S3 and S4 is usually known as a half-bridge.

Various phases are distinguished in the operation of this arrangement.

At first, capacitor C1 is discharged and switch S4 is in its open status. In the first phase, switch Si and switch S2 or S3 are closed. This causes a current to flow from the positive pole of voltage source 110 over switch S1, diode D2, through load 101 and/or 102, through switch S2 and/or S3, back to the negative pole of voltage source 110. During this period of time, electric power is stored in the loads. In this phase, there is a linear increase in the current flowing through the loads.

In the first phase, the activation takes place so quickly that it is not sufficient to cause the loads to react. This makes use of the property of solenoid valves whereby up to a certain current level, the forces acting on the moving parts of the solenoid valve resulting from this current are not enough to cause the parts to move due to the spring force; so up to this current level the solenoid valve is used practically only as a storage throttle.

In the second phase which then follows, the power stored in the solenoid valves is transferred back to capacitor C1. To do so, all the switches are brought to their open status. This causes current to flow from a first terminal of loads 101, 102 through diodes D3, D4, through capacitor C1 and diode D5 and the load.

At the start of activation of the load, which causes fuel to be metered, a third phase begins. In the third phase, the power stored in the capacitor is transferred to the solenoid valve. To do so, switch S1 is switched to its open status and switches S4, S2 and/or S3 are switched to their closed status, resulting in a current flow from the capacitor through switch S4, load 101 and/or 102 and switch S2 or S3 back to capacitor C1. The discharging of the capacitor permits a rapid current rise and thus a rapid power rise, which is necessary to achieve a short response time. Metering of fuel begins in the course of the third phase.

In a fourth phase, step-up network 115 does not have any function, and current flows from power source 110 over diode D1, through switch S4, load 101 and/or 102, switch S2 or S3 back to power supply 110. The current flowing through the loads can be regulated by activating switch S4 or S2 and/or S3. The load to be triggered, which is associated with a cylinder into which fuel is to be metered, is triggered by switches S2 and S3 that are associated with the loads. After the end of fuel metering, switch S4 and switch S2 or S3 for the respective load are opened. This ends the fuel metering.

After the end of the actual fuel metering, the capacitor can be charged to a preselected voltage by repeating phases 1 and 2 several times.

It is especially advantageous if the recharging operation is carried out in several solenoid valves operated in parallel. This makes it possible to greatly increase the recharging rate. Recharging the capacitor permits a significant increase in the voltage on the capacitor, which yields a faster response time. Thanks to the recharging mode, theoretically any voltage is possible on capacitor C1 and thus at the start of activation. To permit recharging, the half-bridge circuit must be expanded by a few components, specifically switch S1, diode D2 and capacitor C1.

Figure 2:
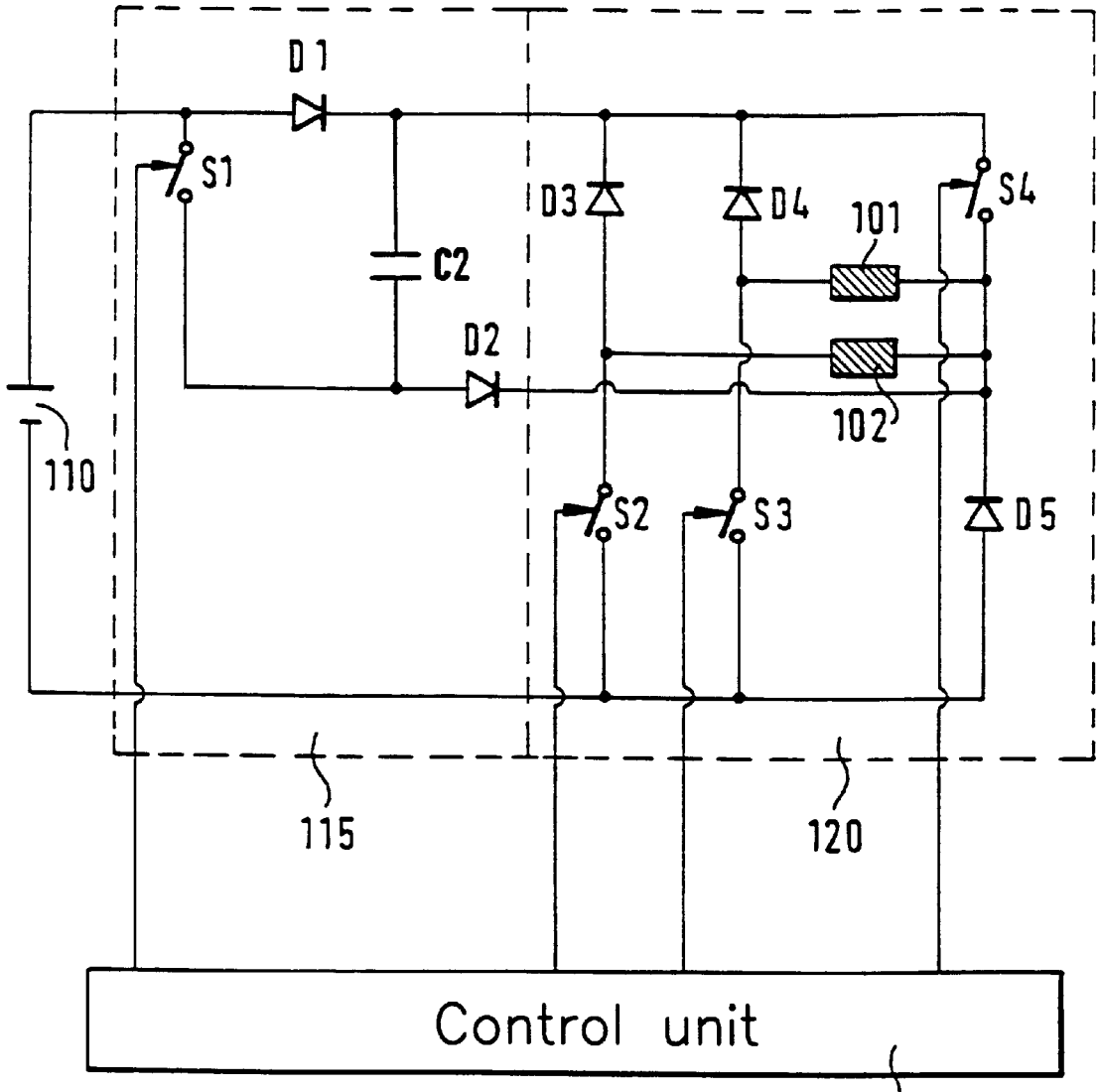
FIG. 2 shows a device according to another embodiment of the present invention.

In the fourth phase, the step-up network 115 has no function. In this phase, the current is regulated by activating switch S4. As an alternative, the current may be regulated by cycling switch S2 and/or S3 while switch S4 is closed. The energy released on opening switch S4 is converted to heat. This energy cannot be utilized using the circuit according to FIG. 1. FIG. 2 shows a modification of this circuit where the energy released on opening switch S4 is used to charge capacitor C2.

In FIG. 2, the elements corresponding to FIG. 1 are labeled with the same reference codes. The important difference in comparison with the circuit according to FIG. 1 is that the capacitor that is labeled as C1 in FIG. 1 is wired between the cathode of diode D1 and the anode of diode D2. This means that capacitor C2 is wired in parallel with switch S4. A parallel connection exists between capacitor C2 and diode D2 connected in series and switch S4. Accordingly, capacitor C2 is connected in parallel to switch S1.

Figure 3A:
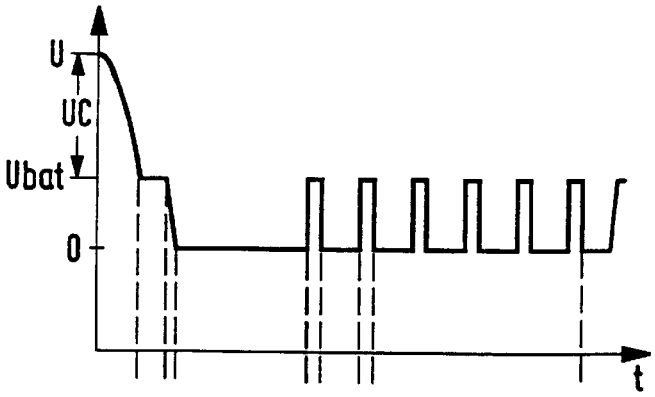
FIGS. 3*a* through 3*d* show several signals plotted over time.
Figure 3B:
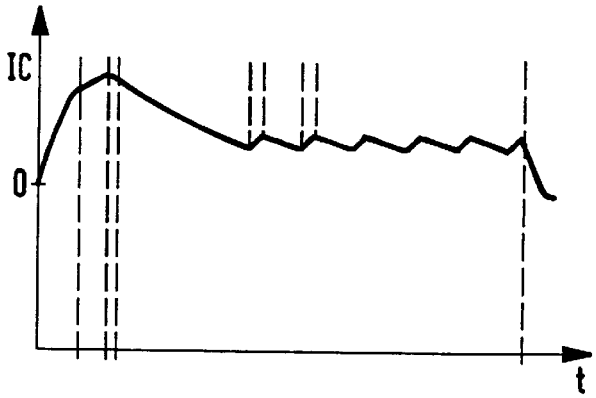
Figure 3C:
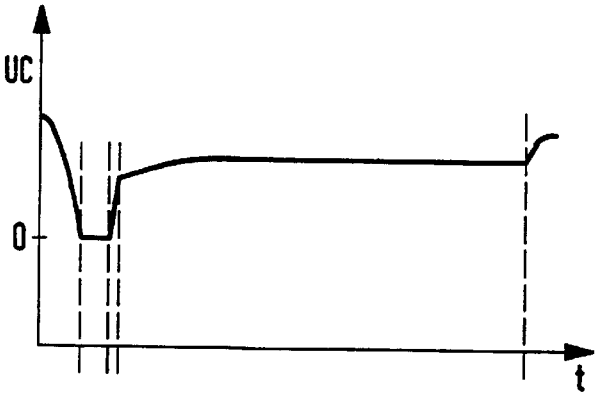
Figure 3D:
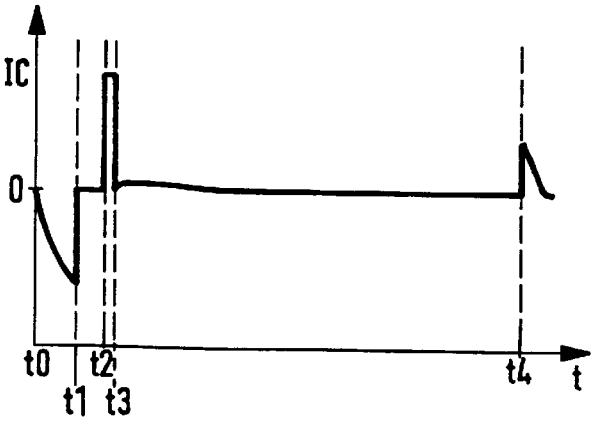

The operation of this arrangement is described using FIGS. 3*a* through 3*d*, which show different signals plotted over time. FIG. 3*a* shows the voltage U applied to diode D5 plotted over time t. This voltage corresponds essentially to the voltage drop across loads 101 and 102. FIG. 3*b* shows the current flowing through load 101 or 102 plotted over time. FIG. 3*c* is a plot of the voltage UC applied to capacitor C2. Accordingly, the plot of the current IC flowing through capacitor C2 over time t is shown in FIG. 3*d*.

Activation of the load begins at time t0. In this first interval, which corresponds to the third phase in FIG. 1, the energy stored in the capacitor is transferred to the solenoid valve. To do so, switch S1, switch S4 and switch S2 or S3 are closed, which results in a flow of current from power source 110, through switch S1, capacitor C2, switch S4, load 101 or 102 and switch S2 or S3 back to power source 110.

With this activation, the power supply and the charged capacitor are connected in series. The voltage drop at diode D5 corresponds to the sum of UC+Ubat, namely voltage UC at the capacitor and voltage Ubat at the voltage source. The voltage source voltage is increased by the capacitor voltage. This yields a rapid rise in the current flowing through the load and thus a short solenoid valve response time.

The capacitor is discharged at time t. This means that the voltage across diode D5 has dropped to the battery voltage Ubat.

The current I flowing through the solenoid valve rises between time t0 and t1. The voltage UC applied to capacitor C2 drops to 0. The current IC flowing through the capacitor drops to a negative value.

After time t1, switch S1 is triggered so that it blocks the current. The current from power source 110 then flows across diode D1, switch S4, load 101 or 102, switch S2 or S3 back to power source 110.

During this phase, the voltage at diode D5 remains at a constant level that corresponds to the battery voltage. The current I through the load increases further. The voltage at capacitor C2 remains at 0, and likewise the current IC flowing through capacitor C2.

Once a predetermined value for the current I flowing through the load has been reached, the current is regulated at a predetermined level by periodically turning switch S4 on and off.

After time t2, capacitor C2 is recharged because it forms a bypass to switch S4 and the current commutates to this capacitor C2. To do so, the switches are triggered so that switches S1 and S4 are blocked and switches S2 and S3 are closed. This results in a current flow from voltage source 110 through diode D1, capacitor C2, diode D2, load 101 or 102 and switch S2 or S3 back to power source 110.

Voltage U at diode D5 drops to 0 and voltage UC on capacitor C2 increases between times t2 and t3. The current I flowing through capacitor C2 increases briefly to a very high positive level. In this phase, capacitor C2 and load 101 and/or 102 are in series so that the same current flows in capacitor C2 and the load.

In the period of time between times t3 and t4, the current is regulated by further opening and closing of switch S4. This interval corresponds to the fourth phase of the circuit according to FIG. 1. Switch S1 is triggered in such a way that it blocks the current.

If the current is lower than the setpoint for the holding current, switches S4 and S2 or S3 are triggered so that the current flows. The current from power supply 110 then flows across diode D1, switch S4, load 101 or 102, switch S2 or S3 back to power supply 110. This corresponds to the interval between t1 and t2.

If the current is greater than the setpoint, the switches are triggered so that switches S1 and S4 are in their blocked status and switch S2 or S3 is in its closed state. This results in a current flow from power supply 110 through diode D1, capacitor C2, diode D2, load 101 or 102 and switch S2 or S3 back to power supply 110. This corresponds to the interval t2 to t3.

Activation ends at time t4, at which time the switches S4 and S2 or S3 are switched to their blocked status. In this status, all the switches are blocked. A current then flows from the load through diode D4, capacitor C2, diode D2 back to load 101 or 102. This phase is also known as high-speed disconnect. The energy stored in the load is used for further charging capacitor C2. Consequently, the voltage U at diode D5 drops back to 0 at time t4, and the current passing through load I also drops to 0 while the voltage at capacitor C2 increases again to its initial level prior to the activation. Accordingly, the current IC flowing through the capacitor increases briefly at time t4 and then drops back to 0.

With the next activation of a load, the entire process described above is repeated.

What is claimed is:

1. A process for activating first and second electromagnetic loads, in a device having a first switch, a second switch coupled to the first electromagnetic load in a first circuit branch, a third switch coupled to the second electromagnetic load in a second circuit branch, a power supply, and a step-up-voltage device, comprising the steps of:

a) providing a first current from the power supply through at least one of the first and second circuit branches, the first current being below a value capable of causing either of the electromagnetic loads to activate; and b) providing a second current from the step-up-voltage device through the first switch to at least one of the first and second circuit branches, the second current causing at least one of the electromagnetic loads to activate.

2. The process according to claim 1, further comprising the step of:

between steps a) and b), providing current from at least one of the first electromagnetic load and the second electromagnetic load to the step-up-voltage device to store energy therein.

3. The process according to claim 1, further comprising the step of:

after step b), providing a third current from the power supply through the first switch to at least one of the first and second circuit branches, the third current being a value capable of causing the electromagnetic loads to activate.

4. A device for activating first and second electromagnetic loads, comprising:

a first switch coupled to a power supply;

a second switch coupled to the power supply and the first electromagnetic load;

a third switch coupled to the power supply and the second electromagnetic load;

a step-up-voltage device coupled in parallel with at least one of the power supply and the first switch; and a control unit, wherein the control unit activates the first, second and third switches so that;

the power supply momentarily provides current through at least one of, on the one hand, the first electromagnetic load and the second switch and, on the other hand, the second electromagnetic load and the third switch, the current being below a value capable of causing either of the electromagnetic loads to activate, and the step-up-voltage device momentarily provides current through the first switch to at least one of, on the one hand, the first electromagnetic load and the second switch and, on the other hand, the second electromagnetic load and the third switch, the current causing at least one of the electromagnetic loads to activate.

5. The device according to claim 4, wherein the control unit operates the first switch, the second switch, and the third switch so that current momentarily flows from at least one of the first electromagnet load and the second electromagnetic load to the step-up-voltage device.

6. The device according to claim 4, wherein the first switch, the second switch, the third switch, the first electromagnetic load, and the second electromagnetic load are arranged with a first end of the first switch being coupled to a first terminal of the power supply, a first end of the second switch being coupled to a second terminal of the power supply, a second end of the second switch being coupled to a second end of the second electromagnetic load, a first end of the third switch being coupled to the second terminal of the power supply, a second end of the third switch being coupled to a second end of the first electromagnetic load, a first end of the first electromagnetic load being coupled to a second end of the first switch, and a first end of the second electromagnetic load being coupled to the second end of the first switch.

7. The device according to claim 4, wherein the step-up-voltage device includes a capacitor and a fourth switch.

8. A process for controlling first and second solenoid valves in a device having:

a first switch coupled to a first terminal of a power supply;

a second switch coupled in series with the first solenoid valve and the first switch;

a third switch coupled in series with the second solenoid valve and the first switch, the third switch and the second solenoid valve together being in parallel with the second switch and the first solenoid valve together; and a step-up-voltage device coupled in parallel with at least one of the first switch and the power supply;

the process comprising the steps of:

providing current momentarily through at least one of, on the one hand, the first solenoid valve and the second switch and, on the other hand, the second solenoid valve and the third switch, the current being below a value capable of causing either of the solenoid valves to open; and providing current momentarily from the step-up-voltage device through the first switch to at least one of, on the one hand, the first solenoid valve and the second switch and, on the other hand, the second solenoid valve and the third switch, the current causing at least one of the first solenoid valve and the second solenoid valve to open.

9. The process according to claim 8, further comprising the step of providing current momentarily from at least one of the first solenoid valve and the second valve to the step-up-voltage device.

10. The process according to claim 8, wherein the step-up-voltage device includes a capacitor and a fourth switch, and the process further comprises the step of:

controlling the fourth switch to charge and discharge the capacitor.

* * * * *